US007548141B2

(12) United States Patent
Matsubara et al.

(10) Patent No.: US 7,548,141 B2
(45) Date of Patent: Jun. 16, 2009

(54) HIGH FREQUENCY FILTER

(75) Inventors: Hideya Matsubara, Tokyo (JP); Shigemitsu Tomaki, Tokyo (JP); Shinichiro Toda, Tokyo (JP); Atsunori Okada, Tokyo (JP)

(73) Assignee: TDK Corporation, Tokyo (JP)

( * ) Notice: Subject to any disclaimer, the term of this patent is extended or adjusted under 35 U.S.C. 154(b) by 214 days.

(21) Appl. No.: 11/643,963

(22) Filed: Dec. 22, 2006

(65) Prior Publication Data

US 2007/0164840 A1 Jul. 19, 2007

(30) Foreign Application Priority Data

Jan. 16, 2006 (JP) ..... 2006-006861

(51) Int. Cl.
*H01P 1/20* (2006.01)
*H01P 5/10* (2006.01)

(52) U.S. Cl. ..... 333/204; 333/26

(58) Field of Classification Search ..... 333/26, 333/175, 204, 205

See application file for complete search history.

(56) References Cited

U.S. PATENT DOCUMENTS

| | | | | |
|---|---|---|---|---|
| 6,351,239 | B1 | 2/2002 | Mizuno et al. | |
| 7,126,444 | B2 | 10/2006 | Fukunaga et al. | |
| 2004/0095212 | A1 * | 5/2004 | Iwasaki et al. | 333/204 |
| 2007/0120627 | A1 * | 5/2007 | Kundu | 333/203 |
| 2007/0152780 | A1 * | 7/2007 | Liao et al. | 333/204 |

FOREIGN PATENT DOCUMENTS

| | | |
|---|---|---|
| JP | U 5-78003 | 10/1993 |
| JP | A 2000-22404 | 1/2000 |
| JP | A-2001-217607 | 8/2001 |
| JP | A-2002-299905 | 10/2002 |
| JP | A-2004-349862 | 12/2004 |
| JP | A 2005-45447 | 2/2005 |
| JP | A 2005-80248 | 3/2005 |

OTHER PUBLICATIONS

U.S. Appl. No. 11/644,007, filed Dec. 22, 2006 in the name of Hideya Matsubara et al.

* cited by examiner

*Primary Examiner*—Benny Lee
*Assistant Examiner*—Gerald Stevens
(74) *Attorney, Agent, or Firm*—Oliff & Berridge, PLC

(57) ABSTRACT

A high frequency filter incorporates: an unbalanced input/output terminal; two balanced input/output terminals; two resonators respectively provided between the unbalanced input/output terminal and the two balanced input/output terminals; and a layered substrate for integrating components of the high frequency filter. The two resonators are inductively coupled to each other, and are also capacitively coupled to each other through two capacitors. Each of the two capacitors is formed using a pair of first and second electrodes and a dielectric layer. The first electrode is connected to one of the resonators via a through hole. The second electrode is connected to the other of the resonators and opposed to the first electrode forming the pair with the second electrode, the dielectric layer being disposed between the second electrode and the first electrode.

4 Claims, 10 Drawing Sheets

HIGH FREQUENCY FILTER

BACKGROUND OF THE INVENTION

1. Field of the Invention

The present invention relates to a layered high frequency filter incorporating a plurality of resonators.

2. Description of the Related Art

With increasing demands for reductions in dimensions and thickness of communications apparatuses conforming to the Bluetooth standard and those for use on a wireless local area network (LAN), techniques for high-density packaging has been required. One of proposals for meeting such a requirement is to integrate components through the use of a layered substrate.

One of components of the above-mentioned communications apparatuses is a band-pass filter that filters reception signals. As the band-pass filter, a layered band-pass filter such as the one disclosed in Japanese Published Patent Application (hereinafter referred to as "JP-A") 2000-22404 is known. The layered band-pass filter incorporates a plurality of resonators formed using conductor layers of a layered substrate. In the layered band-pass filter, respective adjacent ones of the resonators are inductively coupled to each other. For the layered band-pass filter, as disclosed in JP-A 2000-22404, there are cases in which the respective adjacent ones of the resonators are also capacitively coupled to each other. In such cases, it is possible to adjust the frequencies of two attenuation poles and the pass-band width of the band-pass filter by adjusting the magnitude of the inductive coupling and the magnitude of the capacitive coupling. Adjustment of the characteristics of the band-pass filter is thus made easier by capacitively coupling the respective adjacent ones of the resonators to each other, compared with a case in which the respective adjacent ones of the resonators are not capacitively coupled to each other.

JP-A 2000-22404 discloses a technique of capacitively coupling the respective adjacent ones of resonators through the use of a coupling adjusting electrode. The coupling adjusting electrode is opposed to each of two adjacent resonators with a dielectric layer disposed in between.

Japanese Published Utility Model Application (hereinafter referred to as "JP-U") 5-78003 discloses a layered dielectric resonator incorporating a plurality of coil conductors that serve as transmission lines. In this resonator, respective adjacent ones of the coil conductors are opposed to each other with a dielectric layer disposed in between so as to capacitively couple the respective adjacent ones of the coil conductors to each other.

According to the technique disclosed in JP-A 2000-22404, the coupling adjusting electrode is opposed to each of two adjacent resonators with a dielectric layer in between. Consequently, according to this technique, a capacitor is formed between one of the resonators and the coupling adjusting electrode, and another capacitor is formed between the other of the resonators and the coupling adjusting electrode. These two capacitors are connected to each other in series. The respective adjacent two of the resonators are capacitively coupled to each other through such two capacitors connected to each other in series.

According to the technique disclosed in JP-A 2000-22404, the composite capacitance of the two capacitors connected to each other in series is smaller than the capacitance of each of the capacitors. Therefore, in this technique, to make the composite resistance be of a desired value, it is necessary that the area of a region required for forming each of the capacitors, that is, the area of the region in which the coupling adjusting electrode and each of the resonators are opposed to each other, be great to some extent. According to this technique, it is therefore difficult to reduce the size of the filter.

In a layered band-pass filter, it is possible to capacitively couple the respective adjacent two of the resonators to each other through the use of the technique disclosed in JP-U 5-78003. However, this case has a problem that will now be described. In layered band-pass filters, there are some cases in which, when a layered substrate is fabricated, the positional relationship among a plurality of conductor layers disposed at different locations in the direction in which the layers are stacked deviates from a desired positional relationship. This will be hereinafter called displacement of the conductor layers. According to the technique disclosed in JP-U 5-78003, since the two coil conductors are disposed at different locations in the direction in which the layers are stacked, there is a possibility that the relative positional relationship between the coil conductors may vary. If the relative positional relationship between the coil conductors varies, the magnitude of inductive coupling and the magnitude of capacitive coupling between the two coil conductors both vary. Therefore, in the case in which the respective adjacent two of the resonators of the layered band-pass filter are capacitively coupled to each other through the use of the technique disclosed in JP-U 5-78003, the magnitude of inductive coupling and the magnitude of capacitive coupling between adjacent two of the resonators both vary if the relative positional relationship between the two resonators varies due to displacement of the conductor layers. Therefore, this case has a problem that variations in characteristics of the band-pass filter are likely to increase due to the displacement of the conductor layers.

Furthermore, in the case in which the magnitude of inductive coupling and the magnitude of capacitive coupling between adjacent two of the resonators both vary when the relative positional relationship between the resonators varies, there arises a problem that it is difficult to adjust the characteristics of the band-pass filter.

OBJECTS AND SUMMARY OF THE INVENTION

It is a first object of the invention to provide a high frequency filter of a layered type incorporating a plurality of resonators, the filter being capable of achieving a reduction in size and allowing easy adjustment of characteristics thereof.

In addition to the above-mentioned first object, it is a second object of the invention to provide a high frequency filter capable of suppressing variations in characteristics resulting from displacement of conductor layers.

A high frequency filter of the invention includes: a layered substrate including dielectric layers and conductor layers that are alternately stacked; a first resonator and a second resonator that are formed of part of the conductor layers inside the layered substrate and that are inductively coupled to each other; at least one pair of first and second electrodes that are formed of part of the conductor layers inside the layered substrate and that capacitively couple the first and second resonators to each other; and at least one through hole provided inside the layered substrate and connecting the first electrode to one of the first and second resonators. The second electrode is connected to the other one of the first and second resonators and opposed to the first electrode pairing up with the second electrode, one of the dielectric layers inside the layered substrate being disposed between the second electrode and the first electrode.

In the high frequency filter of the invention, the first electrode connected to one of the first and second resonators via the through hole and the second electrode connected to the other one of the first and second resonators are opposed to each other with one of the dielectric layers disposed in between. The first and second resonators are thereby capacitively coupled to each other.

In the high frequency filter of the invention, the first and second resonators may be disposed on an identical one of the dielectric layers inside the layered substrate.

In the high frequency filter of the invention, each of the first and second resonators may be a half-wave resonator with open ends, and two pairs of the first and second electrodes may be provided. One of the two pairs of the first and second electrodes may couple one of the ends of the first resonator to one of the ends of the second resonator, while the other of the two pairs of the first and second electrodes may couple the other of the ends of the first resonator to the other of the ends of the second resonator. In this case, the high frequency filter of the invention may further include an unbalanced input/output terminal for receiving or outputting unbalanced signals, and two balanced input/output terminals for receiving or outputting balanced signals, wherein the first and second resonators may be provided between the unbalanced input/output terminal and the balanced input/output terminals for the sake of circuit configuration.

In the high frequency filter of the invention, the first electrode connected to one of the first and second resonators via the through hole and the second electrode connected to the other one of the first and second resonators are opposed to each other with one of the dielectric layers disposed in between. As a result, a capacitor is formed of the first and second electrodes, and the first and second resonators are capacitively coupled to each other through this capacitor. According to the invention, it is easier to adjust characteristics of the high frequency filter, compared with a case in which the first and second resonators are not capacitively coupled to each other. In addition, according to the invention, it is possible that the area of the region required for forming a capacitor for capacitively coupling the first and second resonators to each other is made smaller, compared with a case in which the first and second resonators are capacitively coupled to each other through two capacitors connected to each other in series. It is thereby possible to achieve a reduction in dimensions of the high frequency filter.

In the high frequency filter of the invention, the first and second resonators may be disposed on an identical one of the dielectric layers inside the layered substrate. In this case, the magnitude of inductive coupling between the first and second resonators will not vary even if there occurs displacement of the conductor layers. Therefore, in this case, it is possible to suppress variations in characteristics resulting from displacement of the conductor layers.

Other and further objects, features and advantages of the invention will appear more fully from the following description.

DETAILED DESCRIPTION OF PREFERRED EMBODIMENTS

First Embodiment

Figure 1:
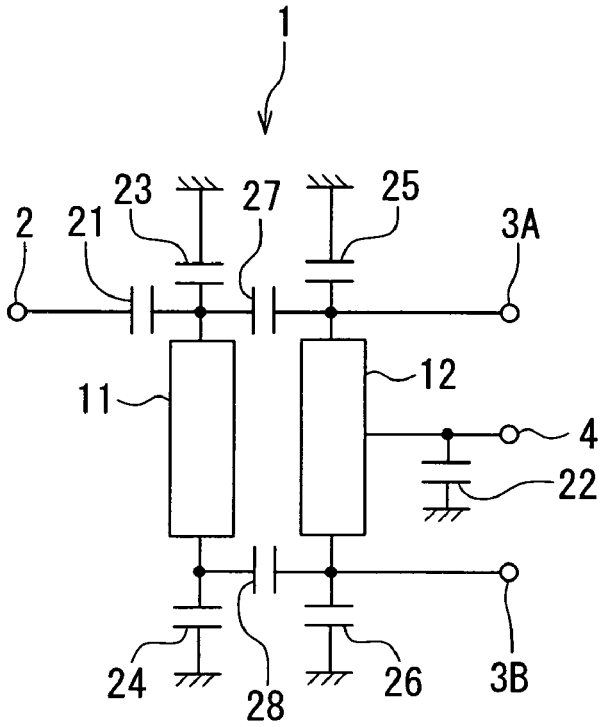
FIG. 1 is a schematic diagram illustrating the circuit configuration of a high frequency filter of a first embodiment of the invention.
Figure 2:
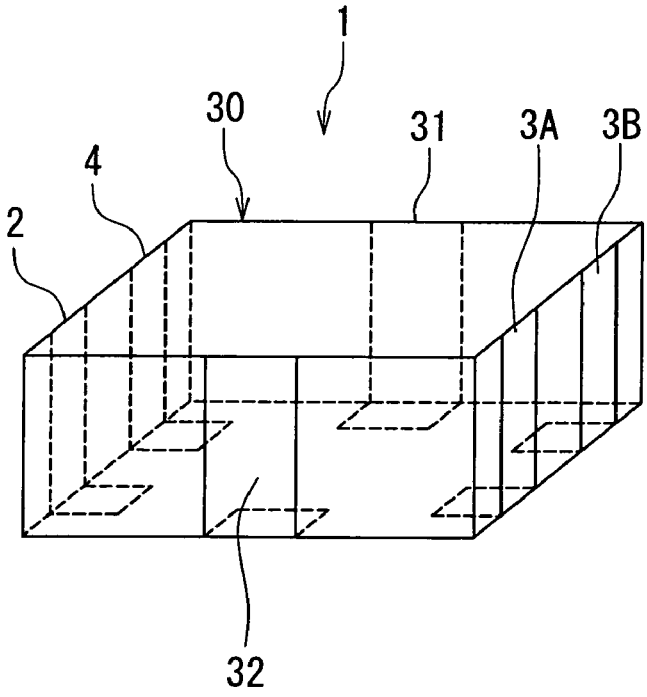
FIG. 2 is a perspective view illustrating an appearance of the high frequency filter of the first embodiment of the invention.
Figure 3:
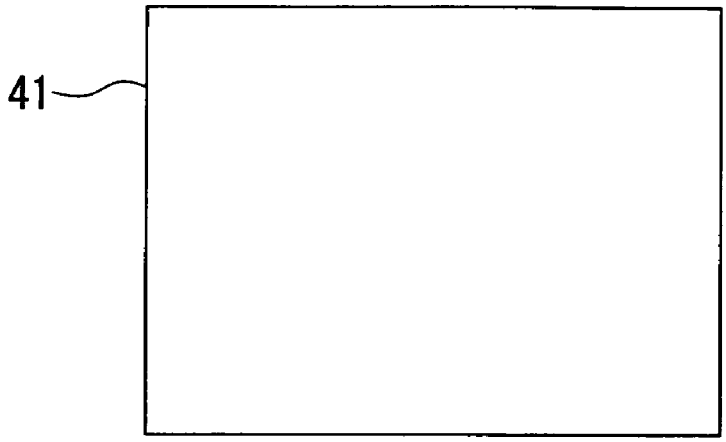
FIG. 3 is a top view of the top surface of a first dielectric layer of the layered substrate of FIG. 2.

Preferred embodiments of the invention will now be described in detail with reference to the accompanying drawings. Reference is now made to FIG. 1 and FIG. 2 to describe the configuration of a high frequency filter of a first embodiment of the invention. FIG. 1 is a schematic diagram illustrating the circuit configuration of the high frequency filter of the embodiment. FIG. 2 is a perspective view illustrating an appearance of the high frequency filter of the embodiment.

As shown in FIG. 1, the high frequency filter 1 of the embodiment incorporates: one unbalanced input/output terminal 2 for receiving or outputting unbalanced signals; two balanced input/output terminals 3A and 3B for receiving or outputting balanced signals; a terminal 4 for direct-current voltage application; and resonators 11 and 12 each of which is formed of a TEM line. The resonators 11 and 12 are provided between the unbalanced input/output terminal 2 and the balanced input/output terminals 3A and 3B for the sake of the circuit configuration. The TEM line is a transmission line for transmitting transverse electromagnetic (TEM) waves that are electromagnetic waves whose electric field and magnetic field exist only in a cross section orthogonal to the direction of travel of the electromagnetic waves.

Each of the resonators 11 and 12 is a half-wave resonator with open ends, and has a shape that is long in one direction.

The resonators 11 and 12 are disposed to be adjacent to each other in parallel and are inductively coupled to each other. The resonator 11 corresponds to the first resonator of the invention and the resonator 12 corresponds to the second resonator of the invention.

The high frequency filter 1 further incorporates a capacitor 21 for input provided between the unbalanced input/output terminal 2 and one of the ends of the resonator 11. The unbalanced input/output terminal 2 is connected to the one of the ends of the resonator 11 through the capacitor 21. However, the unbalanced input/output terminal 2 may be directly connected to the one of the ends of the resonator 11. The balanced input/output terminal 3A is connected to one of the ends of the resonator 12. The balanced input/output terminal 3B is connected to the other of the ends of the resonator 12. The terminal 4 for direct-current voltage application is connected to the resonator 12 at a point near the lengthwise middle of the resonator 12.

The high frequency filter 1 further incorporates: a capacitor 22 provided between the terminal 4 and the ground; a capacitor 23 provided between the one of the ends of the resonator 11 and the ground; a capacitor 24 provided between the other of the ends of the resonator 11 and the ground; a capacitor 25 provided between the one of the ends of the resonator 12 and the ground; and a capacitor 26 provided between the other of the ends of the resonator 12 and the ground.

The high frequency filter 1 further incorporates: a capacitor 27 provided between the one of the ends of the resonator 11 and the one of the ends of the resonator 12; and a capacitor 28 provided between the other of the ends of the resonator 11 and the other of the ends of the resonator 12.

As shown in FIG. 2, the high frequency filter 1 further incorporates a layered substrate 30 for integrating components of the high frequency filter 1. The layered substrate 30 includes dielectric layers and conductor layers alternately stacked, which will be described in detail later. The resonators 11 and 12 are formed using part of the conductor layers inside the layered substrate 30. The resonators 11 and 12 are distributed constant lines. The capacitors 21 to 28 are formed using the conductor layers and the dielectric layers inside the layered substrate 30.

The resonators 11 and 12 are inductively coupled to each other as previously mentioned and are also capacitively coupled to each other through the capacitors 27 and 28. The resonators 11 and 12 form a band-pass filter that selectively allows signals at frequencies within a specific frequency band to pass. The frequency of two attenuation poles and the pass band width of the band-pass filter are adjustable by adjusting the magnitude of inductive coupling and the magnitude of capacitive coupling between the resonators 11 and 12.

The operation of the high frequency filter 1 of the embodiment will now be described. If unbalanced signals are inputted to the unbalanced input/output terminal 2 of the high frequency filter 1, signals at frequencies within a specific frequency band among these unbalanced signals are selectively allowed to pass through the band-pass filter formed of the resonators 11 and 12. There is a 180-degree difference in phase of the electric field between one half portion and the other half portion of each of the resonators 11 and 12 along the longitudinal direction. Consequently, voltages outputted from the balanced input/output terminals 3A and 3B are 180-degree out of phase with each other. Therefore, balanced signals are outputted from the balanced input/output terminals 3A and 3B. On the contrary, if balanced signals are inputted to the balanced input/output terminals 3A and 3B, signals at frequencies within a specific frequency band among these balanced signals are selectively allowed to pass through the band-pass filter formed of the resonators 11 and 12, and unbalanced signals are outputted from the unbalanced input/output terminal 2. As thus described, the high frequency filter 1 of the embodiment has both a function of a band-pass filter and a function of a balun.

The terminal 4 for direct-current voltage application is used for applying a direct-current voltage to the resonator 12. This direct-current voltage may be used for driving an integrated circuit connected to the balanced input/output terminals 3A and 3B, for example. It is not necessarily required that the terminal 4 and the capacitor 22 be provided in the high frequency filter 1.

Reference is now made to FIG. 2 to FIG. 13 to describe the configuration of the layered substrate 30 in detail. As shown in FIG. 2, the layered substrate 30 has a shape of rectangular solid having a top surface, a bottom surface, and four side surfaces. On the side surfaces and the bottom surface of the layered substrate 30, there are disposed the terminals 2, 3A, 3B and 4, and two ground terminals 31 and 32.

FIG. 3 to FIG. 12 respectively illustrate top surfaces of the first dielectric layer to the tenth (lowest) dielectric layer from the top. FIG. 13 illustrates the tenth dielectric layer and a conductor layer therebelow seen from above. No conductor layer is formed on the top surface of the first dielectric layer 41 shown in FIG. 3.

Figure 4:
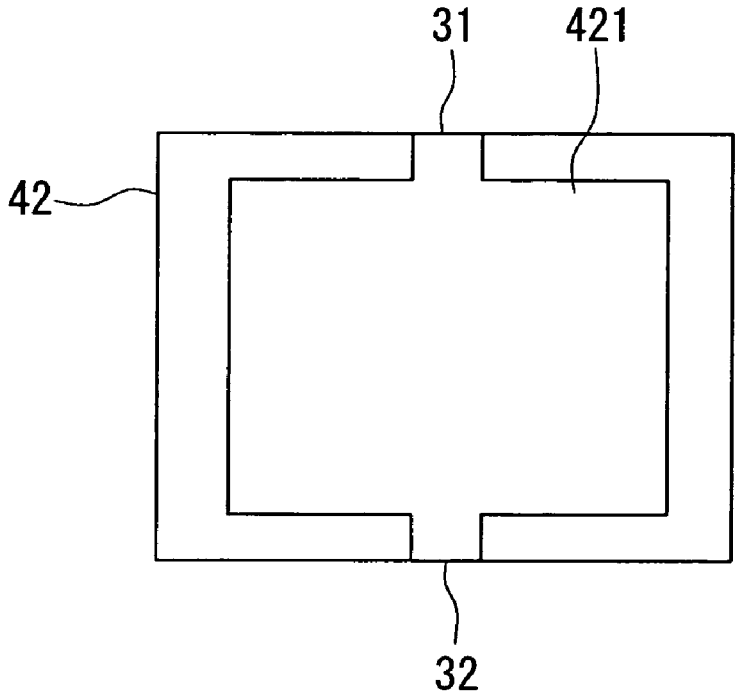
FIG. 4 is a top view of the top surface of a second dielectric layer of the layered substrate of FIG. 2.

A conductor layer 421 for grounding is formed on the top surface of the second dielectric layer 42 shown in FIG. 4. The conductor layer 421 is connected to the ground terminals 31 and 32.

Figure 5:
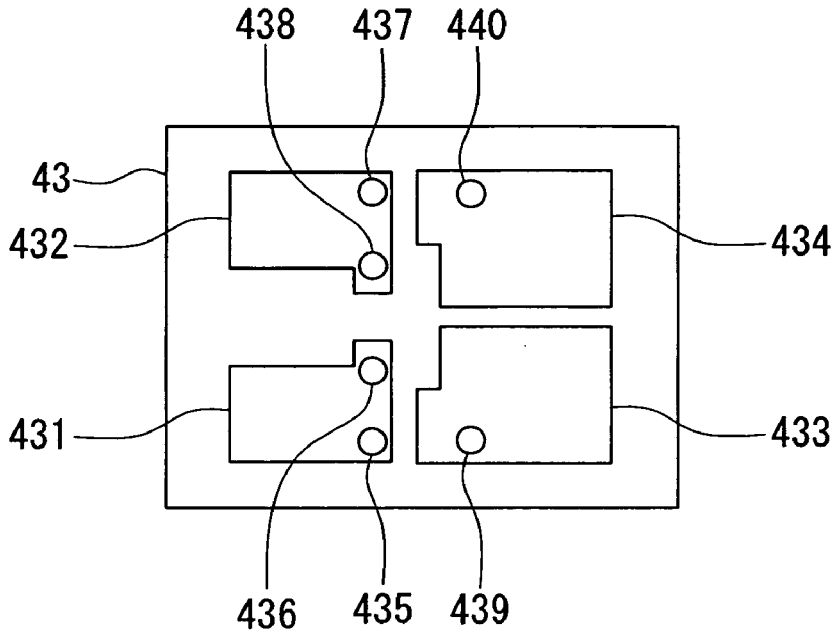
FIG. 5 is a top view of the top surface of a third dielectric layer of the layered substrate of FIG. 2.

Conductor layers 431, 432 and conductor layers 433, 434 for electrodes are formed on the top surface of the third dielectric layer 43 shown in FIG. 5. The dielectric layer 43 has: through holes 435 and 436 connected to the conductor layer 431; through holes 437 and 438 connected to the conductor layer 432; a through hole 439 connected to the conductor layer 433 for electrode; and a through hole 440 connected to the conductor layer 434 for electrode.

The conductor layers 431, 432, 433 and 434 are opposed to the conductor layer 421 for grounding shown in FIG. 4, with the dielectric layer 42 of FIG. 4 disposed in between. The capacitor 23 of FIG. 1 is formed of the conductor layers 431 and 421 and the dielectric layer 42. The capacitor 24 of FIG. 1 is formed of the conductor layers 432 and 421 and the dielectric layer 42. The capacitor 25 of FIG. 1 is formed of the conductor layers 433 and 421 and the dielectric layer 42. The capacitor 26 of FIG. 1 is formed of the conductor layers 434 and 421 and the dielectric layer 42.

Figure 6:
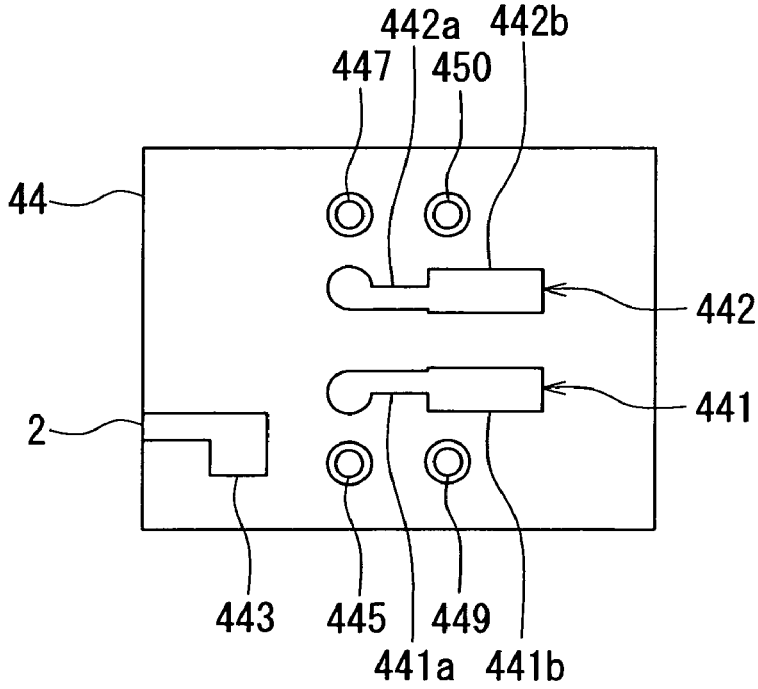
FIG. 6 is a top view of the top surface of a fourth dielectric layer of the layered substrate of FIG. 2.

Conductor layers 441 and 442 for electrodes and a conductor layer 443 are formed on the top surface of the fourth dielectric layer 44 shown in FIG. 6. The conductor layer 443 is connected to the unbalanced input/output terminal 2. The conductor layer 443 is opposed to the conductor layer 431 shown in FIG. 5, with the dielectric layer 43 of FIG. 5 disposed in between. The capacitor 21 for input shown in FIG. 1 is formed of the conductor layers 431 and 443 and the dielectric layer 43.

The conductor layer 441 for electrode includes a long and narrow portion 441*a* and a portion 441*b* greater in width than the portion 441*a*. The conductor layer 431 of FIG. 5 is connected to an end of the portion 441*a* via the through hole 436 of FIG. 5. An end of the portion 441*b* is coupled to the other end of the portion 441*a*. The portion 441*b* is opposed to the conductor layer 433 for electrode shown in FIG. 5, with the dielectric layer 43 of FIG. 5 disposed in between. The capacitor 27 shown in FIG. 1 is formed of the conductor layers 441 and 433 and the dielectric layer 43. The conductor layers 441 and 433 for electrodes respectively correspond to the first and second electrodes of one of the two pairs of the invention.

Similarly, the conductor layer 442 for electrode includes a long and narrow portion 442*a* and a portion 442*b* greater in width than the portion 442*a*. The conductor layer 432 of FIG. 5 is connected to an end of the portion 442*a* via the through hole 438 of FIG. 5. An end of the portion 442*b* is coupled to the other end of the portion 442*a*. The portion 442*b* is opposed to the conductor layer 434 for electrode shown in FIG. 5, with the dielectric layer 43 of FIG. 5 disposed in between. The capacitor 28 shown in FIG. 1 is formed of the conductor layers 442 and 434 and the dielectric layer 43. The conductor layers 442 and 434 for electrodes respectively correspond to the first and second electrodes of the other of the two pairs of the invention.

The dielectric layer 44 has through holes 445, 447, 449 and 450. The through holes 435, 437, 439 and 440 shown in FIG. 5 are respectively connected to the through holes 445, 447, 449 and 450.

Figure 7:
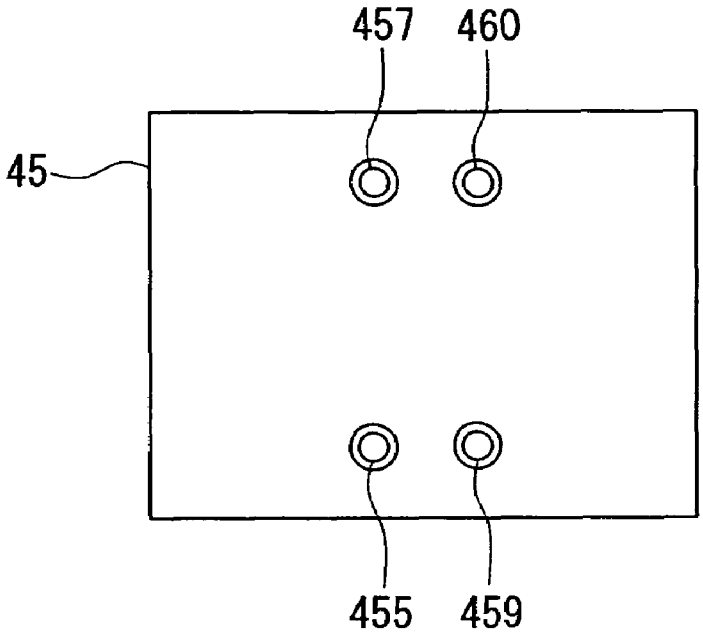
FIG. 7 is a top view of the top surface of a fifth dielectric layer of the layered substrate of FIG. 2.

The fifth dielectric layer 45 shown in FIG. 7 has through holes 455, 457, 459 and 460. The through holes 445, 447, 449 and 450 shown in FIG. 6 are respectively connected to the through holes 455, 457, 459 and 460.

Figure 8:
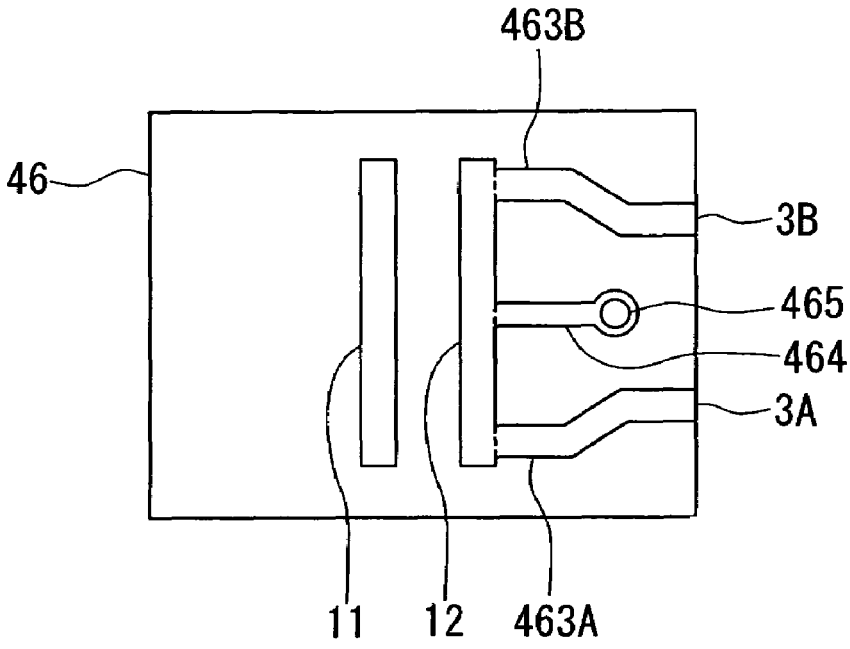
FIG. 8 is a top view of the top surface of a sixth dielectric layer of the layered substrate of FIG. 2.

The resonators 11 and 12 are formed on the top surface of the sixth dielectric layer 46 shown in FIG. 8. The resonators 11 and 12 are disposed to be adjacent to each other in parallel on the same dielectric layer 46 and are inductively coupled to each other.

The conductor layer 431 shown in FIG. 5 is connected to the one of the ends of the resonator 11 via the through holes 435, 445 and 455. The conductor layer 431 is connected to the conductor layer 441 for electrode shown in FIG. 6 via the through hole 436. Consequently, the conductor layer 441 is physically and electrically connected to the one of the ends of the resonator 11 via the through hole 436, the conductor layer 431 and the through holes 435, 445 and 455.

The conductor layer 432 shown in FIG. 5 is connected to the other of the ends of the resonator 11 via the through holes 437, 447 and 457. The conductor layer 432 is connected to the conductor layer 442 for electrode shown in FIG. 6 via the through hole 438. Consequently, the conductor layer 442 is physically and electrically connected to the other of the ends of the resonator 11 via the through hole 438, the conductor layer 432 and the through holes 437, 447 and 457.

The conductor layer 433 for electrode shown in FIG. 5 is physically and electrically connected to the one of the ends of the resonator 12 via the through holes 439, 449 and 459. The conductor layer 434 for electrode shown in FIG. 5 is physically and electrically connected to the other of the ends of the resonator 12 via the through holes 440, 450 and 460.

Conductor layers 463A, 463B and 464 are further formed on the top surface of the dielectric layer 46. The conductor layer 463A has an end connected to the one of the ends of the resonator 12, and has the other end connected to the balanced input/output terminal 3A. The conductor layer 463B has an end connected to the other of the ends of the resonator 12, and has the other end connected to the balanced input/output terminal 3B. The conductor layer 464 has an end connected to the resonator 12 at the point near the lengthwise middle of the resonator 12. The dielectric layer 46 has a through hole 465 connected to the other end of the conductor layer 464.

Figure 9:
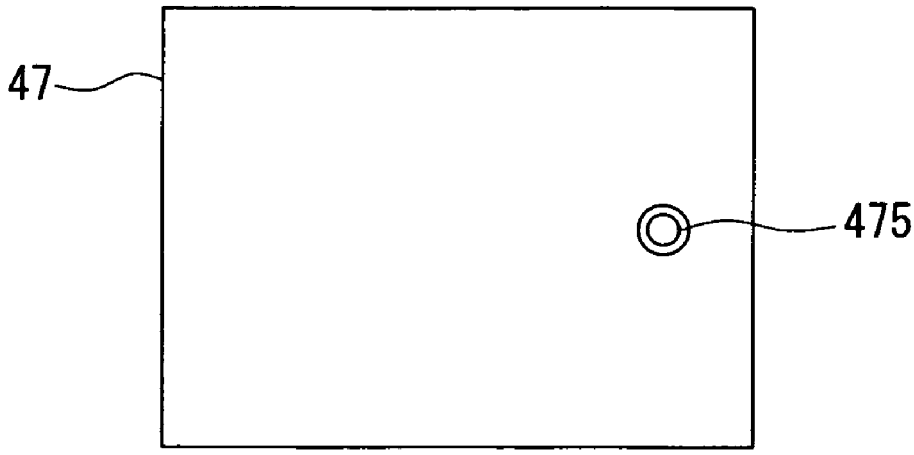
FIG. 9 is a top view of the top surface of a seventh dielectric layer of the layered substrate of FIG. 2.

The seventh dielectric layer 47 shown in FIG. 9 has a through hole 475. The through hole 465 shown in FIG. 8 is connected to the through hole 475.

Figure 10:
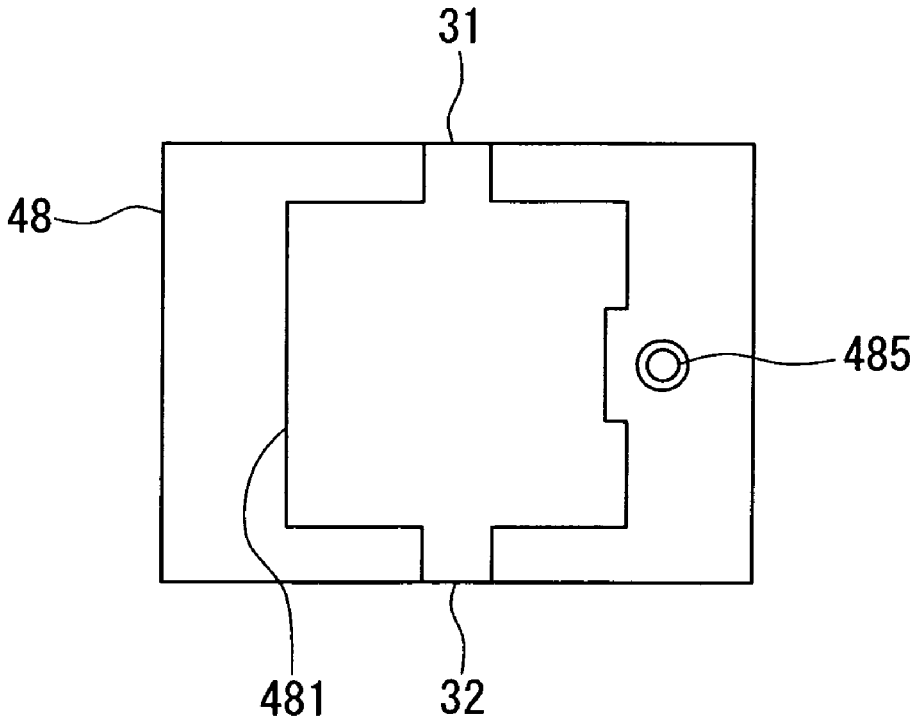
FIG. 10 is a top view of the top surface of an eighth dielectric layer of the layered substrate of FIG. 2.

A conductor layer 481 for grounding is formed on the top surface of the eighth dielectric layer 48 shown in FIG. 10. The conductor layer 481 is connected to the ground terminals 31 and 32. The dielectric layer 48 has a through hole 485. The through hole 475 shown in FIG. 9 is connected to the through hole 485.

Figure 11:
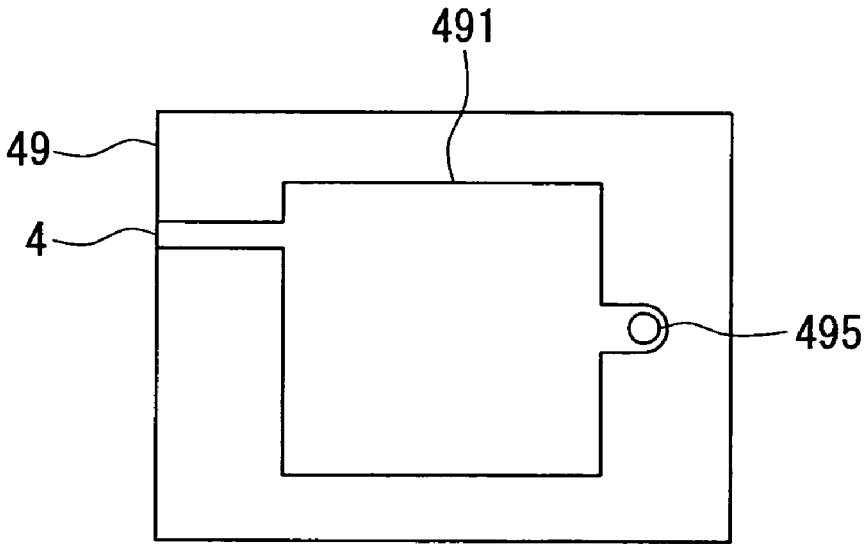
FIG. 11 is a top view of the top surface of a ninth dielectric layer of the layered substrate of FIG. 2.

A conductor layer 491 is formed on the top surface of the ninth dielectric layer 49 shown in FIG. 11. The conductor layer 491 is connected to the terminal 4 for direct-current voltage application. The dielectric layer 49 has a through hole 495 connected to the conductor layer 491. The through hole 485 of FIG. 10 is connected to the through hole 495.

Figure 12:
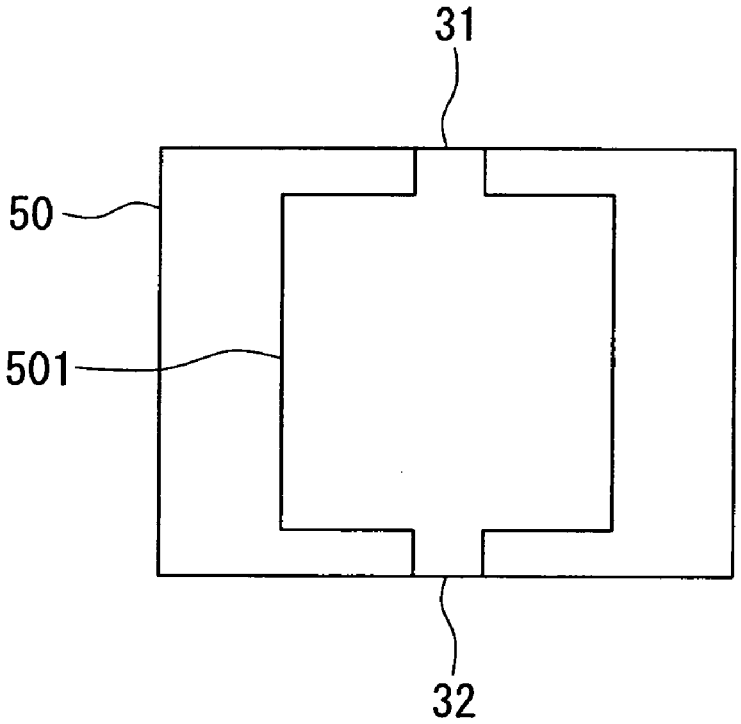
FIG. 12 is a top view of the top surface of a tenth dielectric layer of the layered substrate of FIG. 2.
Figure 13:
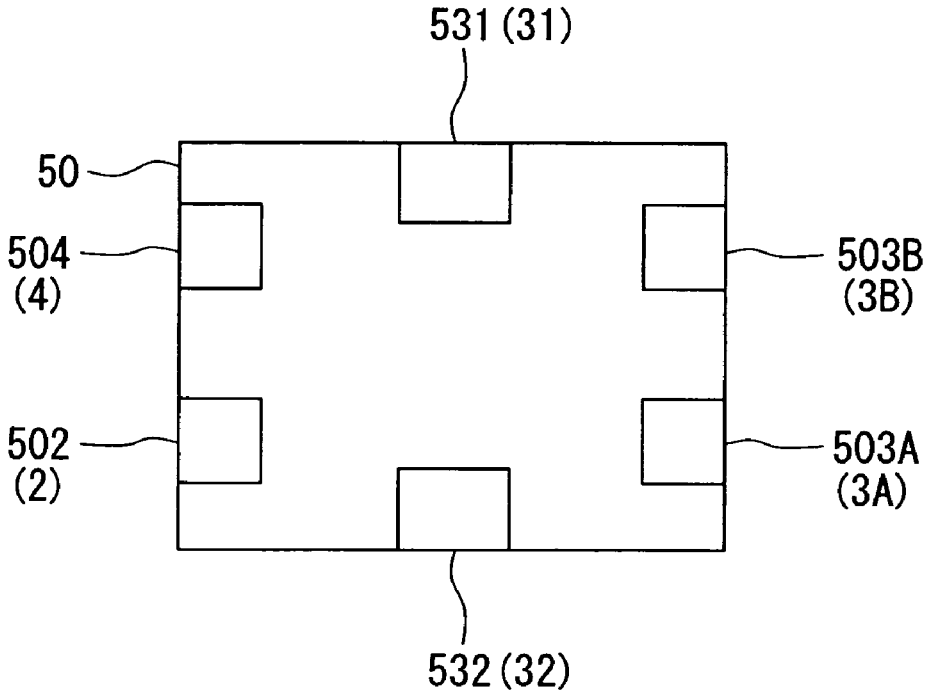
FIG. 13 is a top view illustrating the tenth dielectric layer and a conductor layer therebelow of the layered substrate of FIG. 2.

A conductor layer 501 for grounding is formed on the top surface of the tenth dielectric layer 50 shown in FIG. 12. The conductor layer 501 is connected to the ground terminals 31 and 32. The conductor layer 491 shown in FIG. 11 is opposed to the conductor layer 481 shown in FIG. 10, with the dielectric layer 48 of FIG. 10 disposed in between, and is also opposed to the conductor layer 501 shown in FIG. 12, with the dielectric layer 49 of FIG. 11 disposed in between. The capacitor 22 shown in FIG. 1 is formed of the conductor layers 481, 491 and 501 and the dielectric layers 48 and 49.

As shown in FIG. 13, conductor layers 502, 503A, 503B, 504, 531 and 532 that respectively form the terminals 2, 3A, 3B, 4, 31 and 32 are formed on the bottom surface of the dielectric layer 50, that is, on the bottom surface of the layered substrate 30.

In the embodiment, the layered substrate 30 may be chosen out of a variety of types of substrates, such as one in which the dielectric layers are made of a resin, a ceramic, or a combination of these. However, it is preferred that the layered substrate 30 be a multilayer substrate of low-temperature co-fired ceramic that exhibits an excellent high frequency characteristic.

As described so far, in the high frequency filter 1 of the embodiment, the conductor layers 441 and 433 for electrodes are opposed to each other with the dielectric layer 43 disposed in between. The conductor layer 441 is connected to the one of the ends of the resonator 11 via the through hole 436, the conductor layer 431 and the through holes 435, 445 and 455. The conductor layer 433 is connected to the one of the ends of the resonator 12 via the through holes 439, 449 and 459. The conductor layers 441 and 433 and the dielectric layer 43 form the capacitor 27 connecting the one of the ends of the resonator 11 to the one of the ends of the resonator 12.

In the high frequency filter 1, the conductor layers 442 and 434 for electrodes are opposed to each other with the dielectric layer 43 disposed in between. The conductor layer 442 is connected to the other of the ends of the resonator 11 via the through hole 438, the conductor layer 432 and the through holes 437, 447 and 457. The conductor layer 434 is connected to the other of the ends of the resonator 12 via the through holes 440, 450 and 460. The conductor layers 442 and 434 and the dielectric layer 43 form the capacitor 28 connecting the other of the ends of the resonator 11 to the other of the ends of the resonator 12.

In such a manner, in the high frequency filter 1, the resonators 11 and 12 are capacitively coupled to each other through the capacitors 27 and 28. According to the embodiment, it is easier to adjust the characteristics of the high frequency filter 1, compared with the case in which the resonators 11 and 12 are not capacitively coupled to each other.

According to the embodiment, it is possible to reduce the area of the region required to form the capacitors 27 and 28 for capacitively coupling the resonators 11 and 12 to each other, compared with the case in which the resonators 11 and 12 are capacitively coupled to each other through two capacitors connected to each other in series. It is therefore possible to reduce the size of the high frequency filter 1.

According to the embodiment, by providing the capacitors 23 to 26 between the ground and the respective ends of the resonators 11 and 12, it is possible to make the physical length of the resonators 11 and 12 smaller than a half of the wavelength corresponding to the center frequency of the pass band of the band-pass filter. According to the embodiment, it is thereby possible to reduce the size of the high frequency filter 1.

According to the embodiment, it is possible to reduce the area of the region required to form the capacitors 27 and 28 for capacitively coupling the resonators 11 and 12 to each other as previously described, so that it is possible to improve the characteristics of the high frequency filter 1. That is, if the area of the region required to form the capacitors 27 and 28 is small, it is possible to increase the space around the resonators 11 and 12 where no conductor layer exists, and it is thereby possible to prevent passage of an electric field from being disturbed by conductor layers around the resonators 11 and 12. As a result, it is possible to increase the Q values of the resonators 11 and 12 and to thereby improve the characteristics of the high frequency filter 1.

According to the embodiment, the resonators 11 and 12 are disposed on the same dielectric layer 46 inside the layered substrate 30. As a result, even if there occurs displacement of the conductor layers while the layered substrate 30 is fabricated, the relative positional relationship between the resonators 11 and 12 will not vary, and the magnitude of inductive coupling between the resonators 11 and 12 will not vary, either. Therefore, according to the embodiment, it is possible to suppress variations in characteristics of the high frequency filter 1 resulting from displacement of the conductor layers.

Second Embodiment

Figure 14:
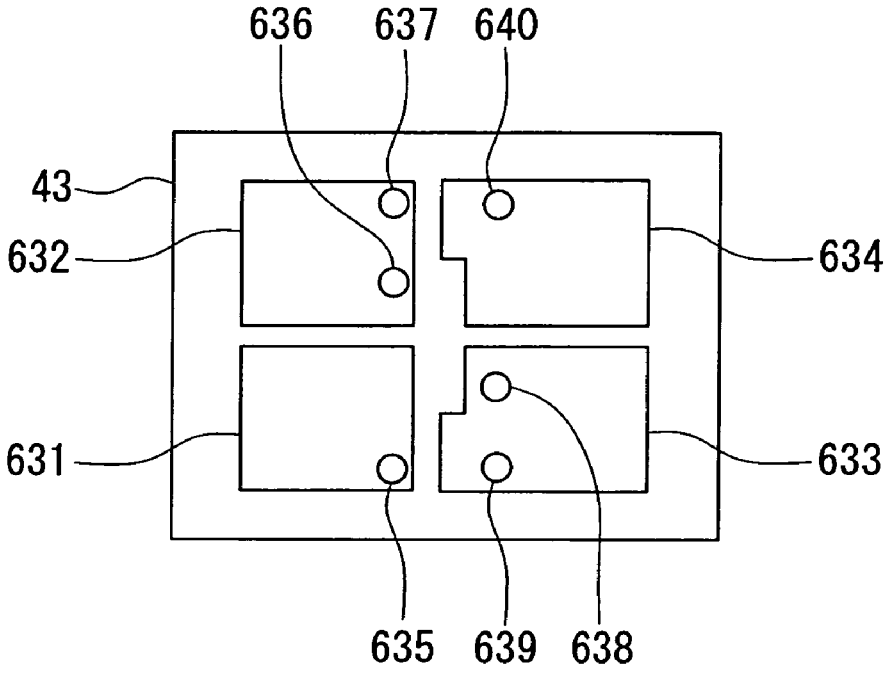
FIG. 14 is a top view of the top surface of a third dielectric layer of a layered substrate of a high frequency filter of a second embodiment of the invention.
Figure 15:
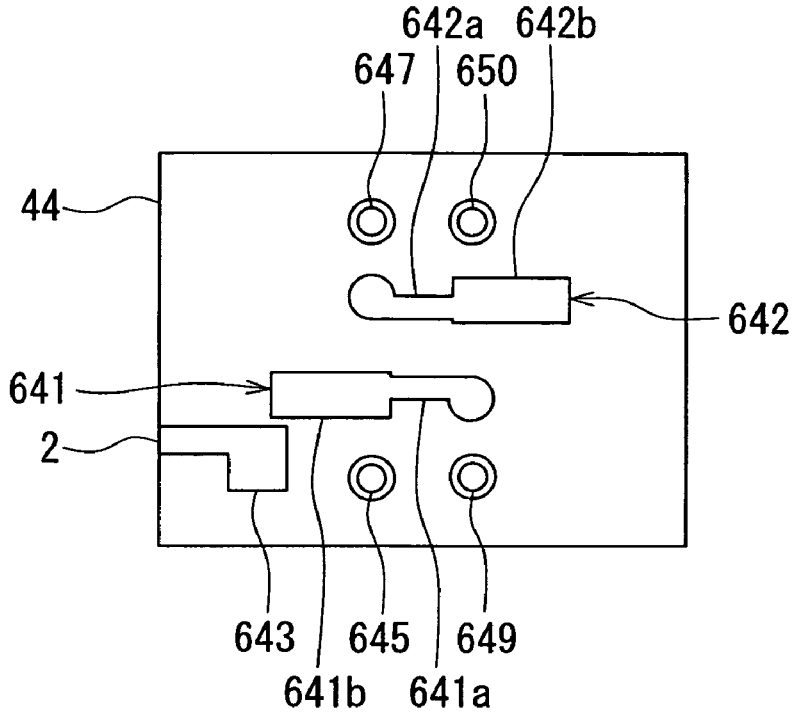
FIG. 15 is a top view of the top surface of a fourth dielectric layer of the layered substrate of the high frequency filter of the second embodiment of the invention.

Reference is now made to FIG. 14 and FIG. 15 to describe a high frequency filter of a second embodiment of the invention. In the high frequency filter 1 of the second embodiment, the configuration of conductor layers respectively formed on the top surfaces of the third and fourth dielectric layers from the top of the layered substrate 30 and the configuration of through holes formed in the third and fourth dielectric layers are different from those of the first embodiment. FIG. 14 illustrates the top surface of the third dielectric layer of the second embodiment. FIG. 15 illustrates the top surface of the fourth dielectric layer of the second embodiment.

As shown in FIG. 14, conductor layers 631 and 634 for electrodes and conductor layers 632 and 633 are formed on the top surface of the third dielectric layer 43 of the second embodiment. The dielectric layer 43 has: a through hole 635 connected to the conductor layer 631; through holes 636 and 637 connected to the conductor layer 632; through holes 638 and 639 connected to the conductor layer 633; and a through hole 640 connected to the conductor layer 634.

The conductor layers 631, 632, 633 and 634 are opposed to the conductor layer 421 for grounding shown in FIG. 4, with the dielectric layer 42 of FIG. 4 disposed in between. The capacitor 23 shown in FIG. 1 is formed of the conductor layers 631 and 421 and the dielectric layer 42. The capacitor 24 shown in FIG. 1 is formed of the conductor layers 632 and 421 and the dielectric layer 42. The capacitor 25 shown in FIG. 1 is formed of the conductor layers 633 and 421 and the dielectric layer 42. The capacitor 26 shown in FIG. 1 is formed of the conductor layers 634 and 421 and the dielectric layer 42.

As shown in FIG. 15, conductor layers 641 and 642 for electrodes and a conductor layer 643 are formed on the top surface of the fourth dielectric layer 44 of the second embodiment. The conductor layer 643 is connected to the unbalanced input/output terminal 2. The conductor layer 643 is opposed to the conductor layer 631 shown in FIG. 14, with the dielectric layer 43 of FIG. 14 disposed in between. The capacitor 21 for input shown in FIG. 1 is formed of the conductor layers 631 and 643 and the dielectric layer 43.

The conductor layer 641 for electrode includes a long and narrow portion 641*a* and a portion 641*b* greater in width than the portion 641*a*. The conductor layer 633 shown in FIG. 14 is connected to an end of the portion 641*a* via the through hole 638 shown in FIG. 14. An end of the portion 641*b* is coupled to the other end of the portion 641*a*. The portion 641*b* is opposed to the conductor layer 631 for electrode shown in FIG. 14, with the dielectric layer 43 of FIG. 14 disposed in between. The capacitor 27 shown in FIG. 1 is formed of the conductor layers 641 and 631 and the dielectric layer 43. The conductor layers 641 and 631 for electrodes respectively correspond to the first and second electrodes of one of the two pairs of the invention.

Similarly, the conductor layer 642 for electrode includes a long and narrow portion 642*a* and a portion 642*b* greater in width than the portion 642*a*. The conductor layer 632 shown in FIG. 14 is connected to an end of the portion 642*a* via the through hole 636 shown in FIG. 14. An end of the portion 642*b* is coupled to the other end of the portion 642*a*. The portion 642*b* is opposed to the conductor layer 634 for electrode shown in FIG. 14, with the dielectric layer 43 of FIG. 14 disposed in between. The capacitor 28 shown in FIG. 1 is formed of the conductor layers 642 and 634 and the dielectric layer 43. The conductor layers 642 and 634 for electrodes respectively correspond to the first and second electrodes of the other of the two pairs of the invention.

The dielectric layer 44 has through holes 645, 647, 649 and 650. The through holes 635, 637, 639 and 640 shown in FIG. 14 are respectively connected to the through holes 645, 647, 649 and 650.

In the second embodiment, the through holes 645, 647, 649 and 650 shown in FIG. 15 are respectively connected to the through holes 455, 457, 459 and 460 formed in the fifth dielectric layer 45 shown in FIG. 7.

In the high frequency filter 1 of the second embodiment, the conductor layers 641 and 431 for electrodes are opposed to each other with the dielectric layer 43 disposed in between. The conductor layer 641 is connected to the one of the ends of the resonator 12 via the through hole 638, the conductor layer 633 and the through holes 639, 649 and 459. The conductor layer 431 is connected to the one of the ends of the resonator 11 via the through holes 635, 645 and 455. The conductor layers 641 and 631 and the dielectric layer 43 form the capacitor 27 connecting the one of the ends of the resonator 11 to the one of the ends of the resonator 12.

In the high frequency filter 1 of the embodiment, the conductor layers 642 and 634 for electrodes are opposed to each other with the dielectric layer 43 disposed in between. The conductor layer 642 is connected to the other of the ends of the resonator 11 via the through hole 636, the conductor layer 632 and the through holes 637, 647 and 457. The conductor layer 634 is connected to the other of the ends of the resonator 12 via the through holes 640, 650 and 460. The conductor layers 642 and 634 and the dielectric layer 43 form the capacitor 28 connecting the other of the ends of the resonator 11 to the other of the ends of the resonator 12.

The remainder of configuration, function and effects of the second embodiment are similar to those of the first embodiment.

Third Embodiment

Figure 16:
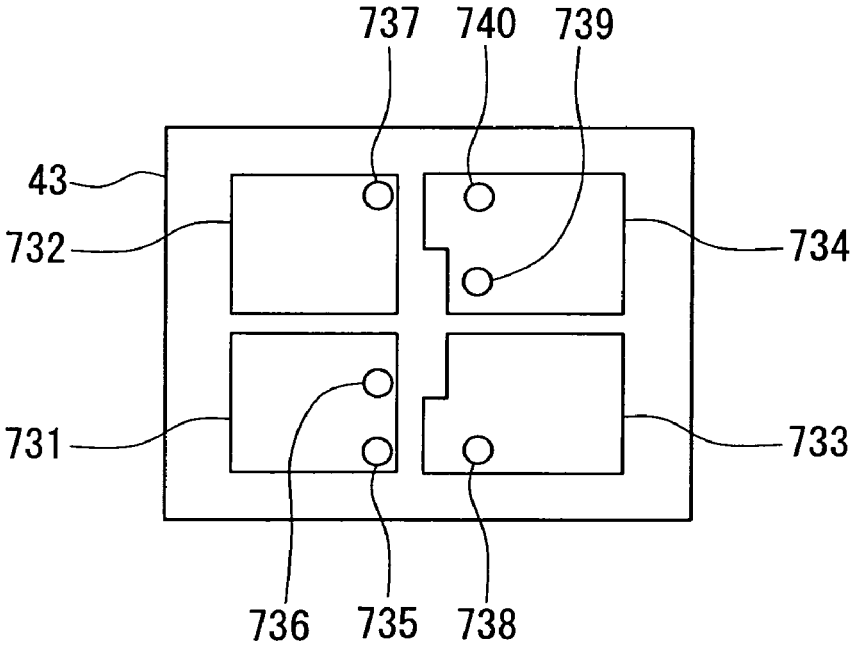
FIG. 16 is a top view of the top surface of a third dielectric layer of a layered substrate of a high frequency filter of a third embodiment of the invention.
Figure 17:
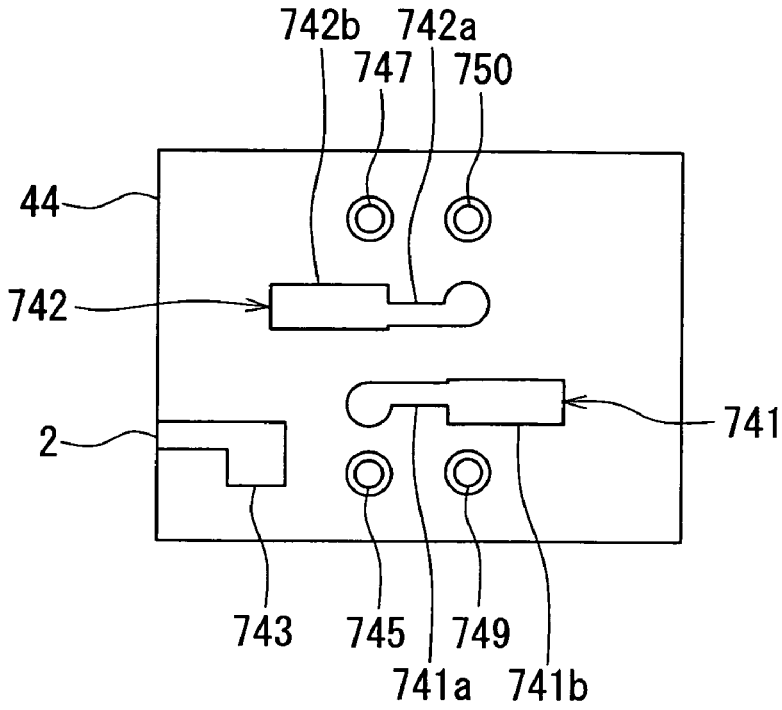
FIG. 17 is a top view of the top surface of a fourth dielectric layer of the layered substrate of the high frequency filter of the third embodiment of the invention.

Reference is now made to FIG. 16 and FIG. 17 to describe a high frequency filter of a third embodiment of the invention. In the high frequency filter 1 of the third embodiment, the configuration of conductor layers respectively formed on the top surfaces of the third and fourth dielectric layers from the top of the layered substrate 30 and the configuration of through holes formed in the third and fourth dielectric layers are different from those of the first embodiment. FIG. 16 illustrates the top surface of the third dielectric layer of the third embodiment. FIG. 17 illustrates the top surface of the fourth dielectric layer of the third embodiment.

As shown in FIG. 16, conductor layers 731, 734 and conductor layers 732, 733 for electrodes are formed on the top surface of the third dielectric layer 43 of the third embodiment. The dielectric layer 43 has: through holes 735 and 736 connected to the conductor layer 731; a through hole 737 connected to the conductor layer 732; a through hole 738 connected to the conductor layer 733; and through holes 739 and 740 connected to the conductor layer 734.

The conductor layers 731, 732, 733 and 734 are opposed to the conductor layer 421 for grounding shown in FIG. 4, with the dielectric layer 42 of FIG. 4 disposed in between. The capacitor 23 shown in FIG. 1 is formed of the conductor layers 731 and 421 and the dielectric layer 42. The capacitor 24 shown in FIG. 1 is formed of the conductor layers 732 and 421 and the dielectric layer 42. The capacitor 25 shown in FIG. 1 is formed of the conductor layers 733 and 421 and the dielectric layer 42. The capacitor 26 shown in FIG. 1 is formed of the conductor layers 734 and 421 and the dielectric layer 42.

As shown in FIG. 17, conductor layers 741 and 742 for electrodes and a conductor layer 743 are formed on the top surface of the fourth dielectric layer 44 of the third embodiment. The conductor layer 743 is connected to the unbalanced input/output terminal 2. The conductor layer 743 is opposed to the conductor layer 731 shown in FIG. 16, with the dielectric layer 43 of FIG. 16 disposed in between. The capacitor 21 for input shown in FIG. 1 is formed of the conductor layers 731 and 743 and the dielectric layer 43.

The conductor layer 741 for electrode includes a long and narrow portion 741*a* and a portion 741*b* greater in width than the portion 741*a*. The conductor layer 731 of FIG. 16 is connected to an end of the portion 741*a* via the through hole 736 of FIG. 16. An end of the portion 741*b* is coupled to the other end of the portion 741*a*. The portion 741*b* is opposed to the conductor layer 733 for electrode shown in FIG. 16, with the dielectric layer 43 of FIG. 16 disposed in between. The capacitor 27 shown in FIG. 1 is formed of the conductor layers 741 and 733 and the dielectric layer 43. The conductor layers 741 and 733 for electrodes respectively correspond to the first and second electrodes of one of the two pairs of the invention.

Similarly, the conductor layer 742 for electrode includes a long and narrow portion 742*a* and a portion 742*b* greater in width than the portion 742*a*. The conductor layer 734 shown in FIG. 16 is connected to an end of the portion 742*a* via the through hole 739 shown in FIG. 16. An end of the portion 742*b* is coupled to the other end of the portion 742*a*. The portion 742*b* is opposed to the conductor layer 732 for electrode shown in FIG. 16, with the dielectric layer 43 of FIG. 16 disposed in between. The capacitor 28 shown in FIG. 1 is formed of the conductor layers 742 and 732 and the dielectric layer 43. The conductor layers 742 and 732 for electrodes respectively correspond to the first and second electrodes of the other of the two pairs of the invention.

The dielectric layer 44 has through holes 745, 747, 749 and 750. The through holes 735, 737, 738 and 740 shown in FIG. 16 are respectively connected to the through holes 745, 747, 749 and 750.

In the third embodiment, the through holes 745, 747, 749 and 750 shown in FIG. 17 are respectively connected to the through holes 455, 457, 459 and 460 formed in the fifth dielectric layer 45 shown in FIG. 7.

In the high frequency filter 1 of the third embodiment, the conductor layers 741 and 733 for electrodes are opposed to each other with the dielectric layer 43 disposed in between. The conductor layer 741 is connected to the one of the ends of the resonator 11 via the through hole 736, the conductor layer 731 and the through holes 735, 745 and 455. The conductor layer 733 is connected to the one of the ends of the resonator 12 via the through holes 738, 749 and 459. The conductor layers 741 and 733 and the dielectric layer 43 form the capacitor 27 connecting the one of the ends of the resonator 11 to the one of the ends of the resonator 12.

In the high frequency filter 1 of the embodiment, the conductor layers 742 and 732 for electrodes are opposed to each other with the dielectric layer 43 disposed in between. The conductor layer 742 is connected to the other of the ends of the resonator 12 via the through hole 739, the conductor layer 734 and the through holes 740, 750 and 460. The conductor layer 732 is connected to the other of the ends of the resonator 11 via the through holes 737, 747 and 457. The conductor layers 742 and 732 and the dielectric layer 43 form the capacitor 28 connecting the other of the ends of the resonator 11 to the other of the ends of the resonator 12.

The remainder of configuration, function and effects of the third embodiment are similar to those of the first embodiment.

Fourth Embodiment

Figure 18:
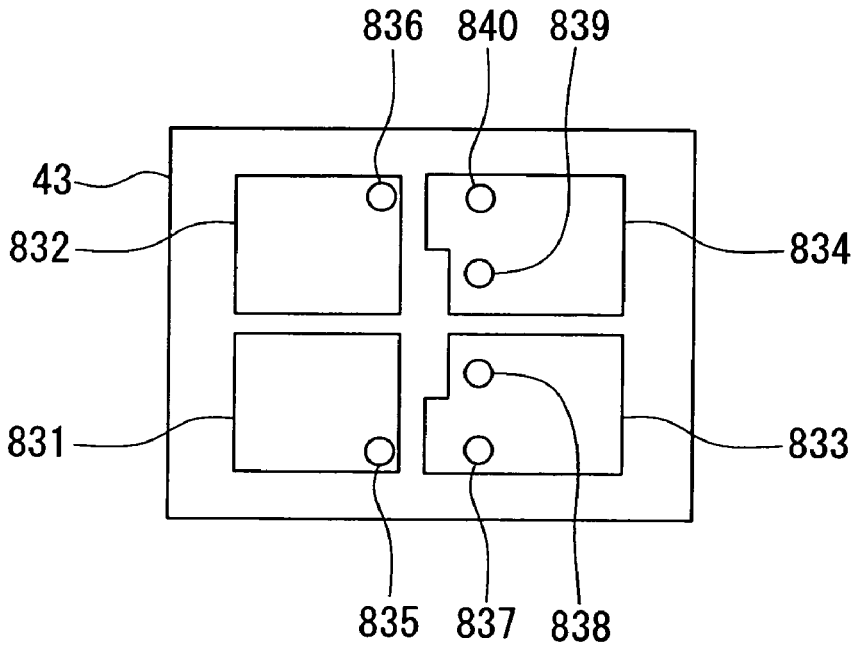
FIG. 18 is a top view of the top surface of a third dielectric layer of a layered substrate of a high frequency filter of a fourth embodiment of the invention.
Figure 19:
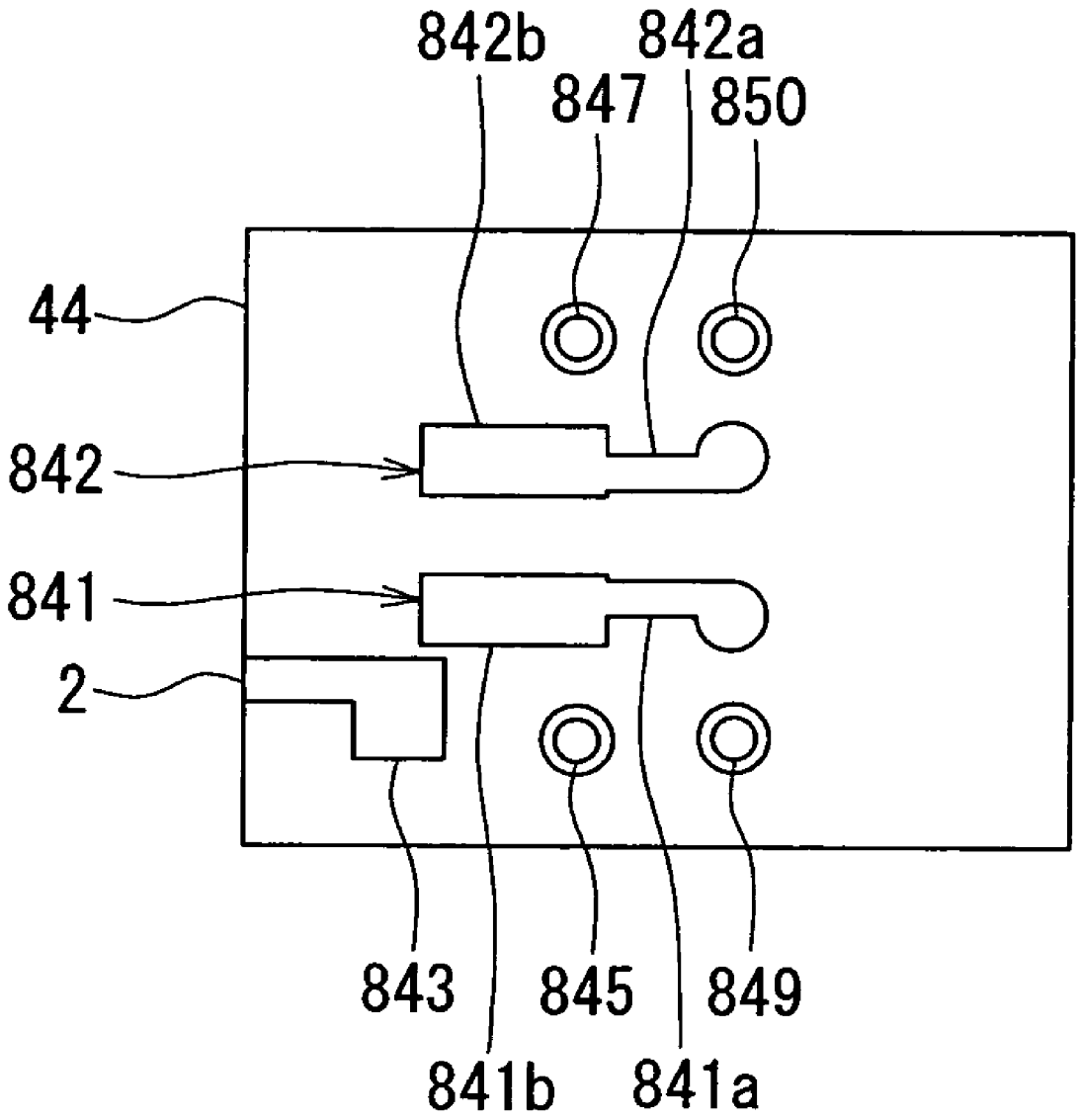
FIG. 19 is a top view of the top surface of a fourth dielectric layer of the layered substrate of the high frequency filter of the fourth embodiment of the invention.

Reference is now made to FIG. 18 and FIG. 19 to describe a high frequency filter of a fourth embodiment of the invention. In the high frequency filter 1 of the fourth embodiment, the configuration of conductor layers respectively formed on the top surfaces of the third and fourth dielectric layers from the top of the layered substrate 30 and the configuration of through holes formed in the third and fourth dielectric layers are different from those of the first embodiment. FIG. 18 illustrates the top surface of the third dielectric layer of the fourth embodiment. FIG. 19 illustrates the top surface of the fourth dielectric layer of the fourth embodiment.

As shown in FIG. 18, conductor layers 831 and 832 for electrodes and conductor layers 833 and 834 are formed on the top surface of the third dielectric layer 43 of the fourth embodiment. The dielectric layer 43 has: a through hole 835 connected to the conductor layer 831; a through hole 836 connected to the conductor layer 832; through holes 837 and 838 connected to the conductor layer 833; and through holes 839 and 840 connected to the conductor layer 834.

The conductor layers 831, 832, 833 and 834 are opposed to the conductor layer 421 for grounding shown in FIG. 4, with the dielectric layer 42 of FIG. 4 disposed in between. The capacitor 23 shown in FIG. 1 is formed of the conductor layers 831 and 421 and the dielectric layer 42. The capacitor 24 shown in FIG. 1 is formed of the conductor layers 832 and 421 and the dielectric layer 42. The capacitor 25 shown in FIG. 1 is formed of the conductor layers 833 and 421 and the dielectric layer 42. The capacitor 26 shown in FIG. 1 is formed of the conductor layers 834 and 421 and the dielectric layer 42.

As shown in FIG. 19, conductor layers 841 and 842 for electrodes and a conductor layer 843 are formed on the top surface of the fourth dielectric layer 44 of the fourth embodiment. The conductor layer 843 is connected to the unbalanced input/output terminal 2. The conductor layer 843 is opposed to the conductor layer 831 shown in FIG. 18, with the dielectric layer 43 of FIG. 18 disposed in between. The capacitor 21 for input shown in FIG. 1 is formed of the conductor layers 831 and 843 and the dielectric layer 43.

The conductor layer 841 for electrode includes a long and narrow portion 841*a* and a portion 841*b* greater in width than the portion 841*a*. The conductor layer 833 shown in FIG. 18 is connected to an end of the portion 841*a* via the through hole 838 shown in FIG. 18. An end of the portion 841*b* is coupled to the other end of the portion 841*a*. The portion 841*b* is opposed to the conductor layer 831 for electrode shown in FIG. 18, with the dielectric layer 43 of FIG. 18 disposed in between. The capacitor 27 shown in FIG. 1 is formed of the conductor layers 841 and 831 and the dielectric layer 43. The conductor layers 841 and 831 for electrodes respectively correspond to the first and second electrodes of one of the two pairs of the invention.

Similarly, the conductor layer 842 for electrode includes a long and narrow portion 842*a* and a portion 842*b* greater in width than the portion 842*a*. The conductor layer 834 shown in FIG. 18 is connected to an end of the portion 842*a* via the through hole 839 shown in FIG. 18. An end of the portion 842*b* is coupled to the other end of the portion 842*a*. The portion 842*b* is opposed to the conductor layer 832 for electrode shown in FIG. 18, with the dielectric layer 43 of FIG. 18 disposed in between. The capacitor 28 shown in FIG. 1 is formed of the conductor layers 842 and 832 and the dielectric layer 43. The conductor layers 842 and 832 for electrodes respectively correspond to the first and second electrodes of the other of the two pairs of the invention.

The dielectric layer 44 has through holes 845, 847, 849 and 850. The through holes 835, 836, 837 and 840 shown in FIG. 18 are respectively connected to the through holes 845, 847, 849 and 850.

In the fourth embodiment, the through holes 845, 847, 849 and 850 shown in FIG. 19 are respectively connected to the through holes 455, 457, 459 and 460 formed in the fifth dielectric layer 45 shown in FIG. 7.

In the high frequency filter 1 of the fourth embodiment, the conductor layers 841 and 831 for electrodes are opposed to each other with the dielectric layer 43 disposed in between. The conductor layer 841 is connected to the one of the ends of the resonator 12 via the through hole 838, the conductor layer 833 and the through holes 837, 849 and 459. The conductor layer 831 is connected to the one of the ends of the resonator 11 via the through holes 835, 845 and 455. The conductor layers 841 and 831 and the dielectric layer 43 form the capacitor 27 connecting the one of the ends of the resonator 11 to the one of the ends of the resonator 12.

In the high frequency filter 1 of the embodiment, the conductor layers 842 and 832 for electrodes are opposed to each other with the dielectric layer 43 disposed in between. The conductor layer 842 is connected to the other of the ends of the resonator 12 via the through hole 839, the conductor layer 834 and the through holes 840, 850 and 460. The conductor layer 832 is connected to the other of the ends of the resonator 11 via the through holes 836, 847 and 457. The conductor layers 842 and 832 and the dielectric layer 43 form the capacitor 28 connecting the other of the ends of the resonator 11 to the other of the ends of the resonator 12.

The remainder of configuration, function and effects of the fourth embodiment are similar to those of the first embodiment.

The present invention is not limited to the foregoing embodiments but may be practiced in still other ways. For example, the high frequency filter of the invention may incorporate three or more resonators disposed in such a manner that the respective adjacent ones of the resonators are inductively coupled to each other. In this case, the respective adjacent ones of the resonators may be capacitively coupled to each other through capacitors having configurations similar to those of the capacitors 27 and 28 disclosed in the embodiments.

In the embodiments the band-pass filter is formed using the resonators 11 and 12 that are half-wave resonators. However, the invention is not only applicable to such a band-pass filter but also to filters in general each incorporating at least two resonators that are inductively coupled and capacitively coupled to each other. For example, the high frequency filter of the invention may be one incorporating a plurality of quarter-wave resonators, or one incorporating a half-wave resonator and a quarter-wave resonator. In the invention, it suffices to provide at least one pair of the first and second electrodes for capacitively coupling two resonators. For example, to capacitively couple two quarter-wave resonators to each other, it is possible by using a pair of the first and second electrodes.

The high frequency filter of the invention is useful as a filter used in communications apparatuses conforming to the Bluetooth standard and those for use on a wireless LAN, such as a band-pass filter in particular.

Obviously many modifications and variations of the present invention are possible in the light of the above teachings. It is therefore to be understood that within the scope of the appended claims the invention may be practiced otherwise than as specifically described.

What is claimed is:

1. A high frequency filter comprising:

a layered substrate including dielectric layers and conductor layers that are alternately stacked;

a first resonator and a second resonator that are formed of part of the conductor layers inside the layered substrate and that are inductively coupled to each other;

at least one pair of first and second electrodes that are formed of part of the conductor layers inside the layered substrate and that capacitively couple the first and second resonators to each other;

at least one first through hole provided inside the layered substrate and connecting the first electrode to one of the first and second resonators; and at least one second through hole provided inside the layered substrate and connecting the second electrode to the other of the first and second resonators, wherein the first and second electrodes are opposed to each other, one of the dielectric layer inside the layered substrate being disposed between the first and second electrodes.

2. The high frequency filter according to claim 1, wherein the first and second resonators are disposed on an identical one of the dielectric layers inside the layered substrate.

3. The high frequency filter according to claim 1, wherein:

each of the first and second resonators is a half-wave resonator with open ends;

two pairs of the first and second electrodes are provided; and one of the two pairs of the first and second electrodes couple one of the ends of the first resonator to one of the ends of the second resonator, while the other of the two pairs of the first and second electrodes couple the other of the ends of the first resonator to the other of the ends of the second resonator.

4. The high frequency filter according to claim 3, further comprising an unbalanced input/output terminal for receiving or outputting unbalanced signals, and two balanced input/output terminals for receiving or outputting balanced signals, wherein the unbalanced input/output terminal is coupled to one of the first and second resonators and the balanced input/output terminals are coupled to the other of the first and second resonators.

* * * * *